US010214974B2

(12) United States Patent
Mabile

(10) Patent No.: US 10,214,974 B2
(45) Date of Patent: Feb. 26, 2019

(54) SYSTEM FOR COMPENSATING HEAVING FOR AN ELEMENT HOOKED ONTO MOVABLE EQUIPMENT

(71) Applicant: IFP Energies nouvelles, Rueil-Malmaison (FR)

(72) Inventor: Claude Mabile, Clamart (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 0 days.

(21) Appl. No.: 15/520,365

(22) PCT Filed: Aug. 28, 2015

(86) PCT No.: PCT/EP2015/069719
§ 371 (c)(1),
(2) Date: Apr. 19, 2017

(87) PCT Pub. No.: WO2016/062437
PCT Pub. Date: Apr. 28, 2016

(65) Prior Publication Data

US 2017/0321498 A1 Nov. 9, 2017

(30) Foreign Application Priority Data

Oct. 20, 2014 (FR) ..... 14 60086

(51) Int. Cl.
*E21B 19/00* (2006.01)
*B66C 13/02* (2006.01)
(Continued)

(52) U.S. Cl.
CPC ..... *E21B 19/006* (2013.01); *B63B 27/30* (2013.01); *B66C 13/02* (2013.01); *B66C 13/52* (2013.01);
(Continued)

(58) Field of Classification Search
CPC ..... E21B 19/09; E21B 19/006; B63B 27/30; B66C 13/02; B66C 13/06
See application file for complete search history.

(56) References Cited

U.S. PATENT DOCUMENTS 3,743,249 A * 7/1973 van Daalen ..... B63B 35/4413 175/27
3,791,628 A 2/1974 Burns et al.
(Continued)

FOREIGN PATENT DOCUMENTS

CN 101654145 A 2/2010
FR 2193775 A1 2/1974
(Continued)

OTHER PUBLICATIONS

International Search Report for PCT/EP2015/069719 dated Oct. 9, 2015; English translation submitted herewith (8 pages).

*Primary Examiner* — Carib A Oquendo
(74) *Attorney, Agent, or Firm* — Fitch, Even, Tabin & Flannery, LLP

(57) ABSTRACT

The present invention relates to a motion compensation system for an element hanging from a mobile unit, the system comprising two blocks, at least two articulated arms, a compensation cylinder and a cable. According to the invention, at least one characteristic length of the articulated system (for example: the length of a link or the distance between two sheaves of two articulated arms) is adjusted according to the motion to be compensated for.

18 Claims, 2 Drawing Sheets

(51) Int. Cl.

| | |
|---|---|
| ***B66C 13/52*** | (2006.01) |
| ***B66D 1/52*** | (2006.01) |
| ***B63B 27/30*** | (2006.01) |
| ***E21B 19/09*** | (2006.01) |

(52) U.S. Cl.
CPC ..... *B66D 1/52* (2013.01); *E21B 19/002* (2013.01); *E21B 19/09* (2013.01)

(56) References Cited

U.S. PATENT DOCUMENTS

| | | | | |
|---|---|---|---|---|
| 4,432,420 | A * | 2/1984 | Gregory | E21B 19/09 166/355 |
| 4,688,764 | A * | 8/1987 | Nayler | B66C 13/02 254/277 |
| 4,886,397 | A * | 12/1989 | Cherbonnier | E21B 19/09 114/264 |
| 5,520,369 | A | 5/1996 | Chatard | |
| 7,231,981 | B2 * | 6/2007 | Moe | E21B 19/006 166/352 |
| 2002/0014966 | A1 * | 2/2002 | Strassner, II | E21B 17/006 340/572.1 |
| 2015/0008382 | A1 * | 1/2015 | Bergan | B63B 39/00 254/398 |

FOREIGN PATENT DOCUMENTS

| | | | |
|---|---|---|---|
| FR | 2575452 | A1 | 7/1986 |
| KR | 20120035432 | A | 4/2012 |
| WO | 2004/001193 | A2 | 12/2003 |

* cited by examiner

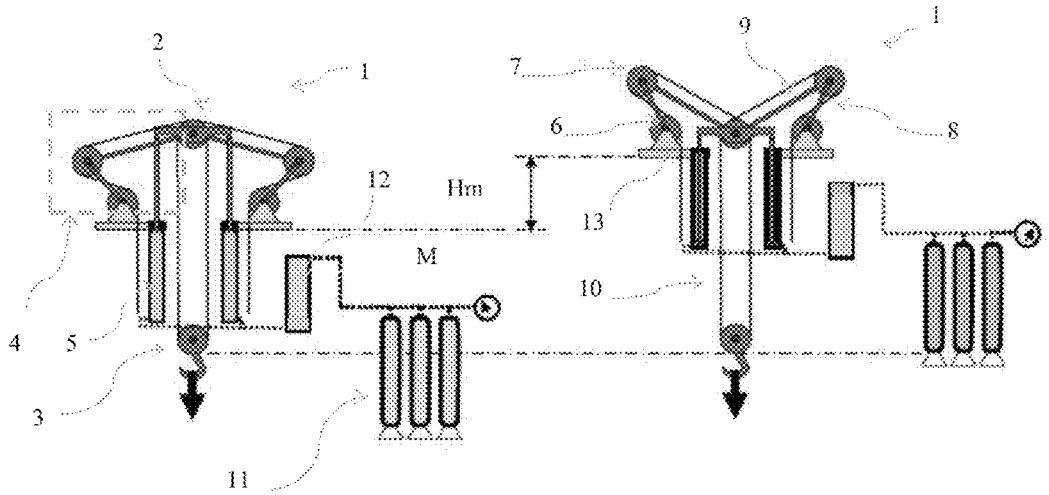
Figure 1a
Figure 1b
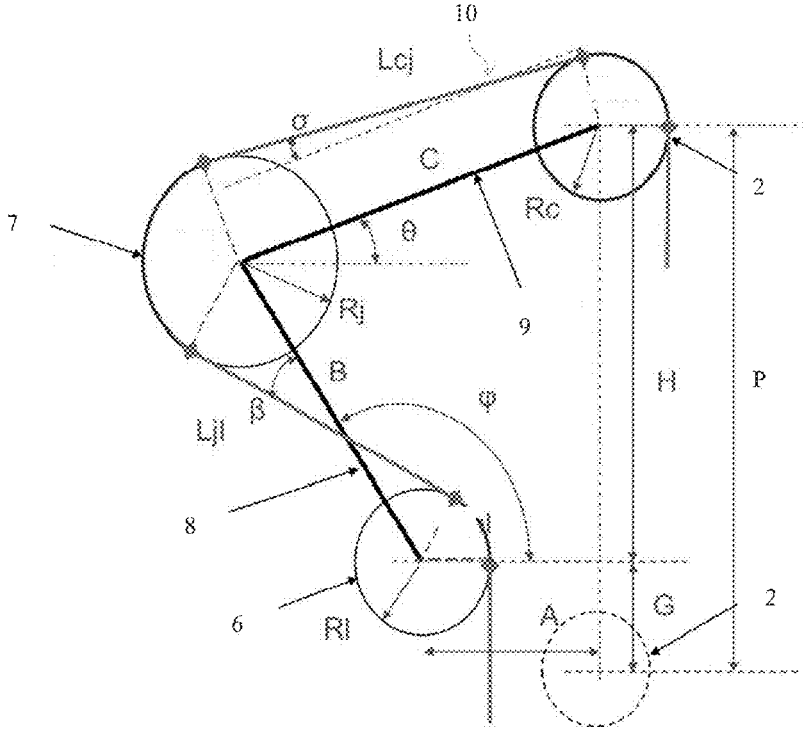
Figure 2

SYSTEM FOR COMPENSATING HEAVING FOR AN ELEMENT HOOKED ONTO MOVABLE EQUIPMENT

CROSS-REFERENCE TO RELATED APPLICATIONS

This application is a U.S. national phase application filed under 35 U.S.C. § 371 of International Application No. PCT/EP2015/069719, filed Aug. 28, 2015, designating the United States, which claims priority from French Patent Application No. 14/60.086, filed Oct. 20, 2014, which are hereby incorporated herein by reference in their entirety for all purposes.

FIELD OF THE INVENTION

The present invention relates to the field of motion compensation for a mobile element hanging from a mobile unit. More particularly, the invention relates to the compensation of an offshore unit heave motion for an offshore drill bit, for a riser pipe or for an offshore blowout preventer setting tool.

BACKGROUND OF THE INVENTION

Indeed, at sea, the wave motion causes, among other things, heave, i.e. an oscillating motion of vertical translation of the floating units. When the latter support tools such as drill bits, the heave needs to be compensated for so that the bit is permanently in contact with the hole bottom.

To compensate for such motions, there are three major families of devices:

- devices that are set in the drill string,
- devices that are interposed between the string and the drill rig lifting system, and
- devices that are integrated in the lifting system.

The type of device of the third family conventionally solves the heave compensation problem by making a first block, referred to as crown block, mobile, and it also comprises a second block, referred to as travelling block. The first block is referred to as crown or stationary block because it is stationary with respect to the mobile unit and the second block is referred to as travelling block because it is mobile with respect to the mobile unit. However, through the agency of the heave compensator, the second block is made substantially stationary with respect to the sea bottom. It is reminded that a block is a mechanical device allowing a load to be lifted by several cable strands.

Furthermore, this type of device generally comprises at least one cylinder connected to accumulators, notably pneumatic accumulators. These accumulators occupy a large volume, which is penalizing, especially for an offshore application.

Documents KR-2012/035,432 and CN-101,654,145 describe examples of compensation systems.

An important quantity for such a device is the variation of the force to be exerted on the first block (crown block) according to the path traveled by the mobile unit in relation to a constant value that it should withstand without heave. The difference between the real force and this constant value is referred to as error.

Furthermore, document FR-2,575,452 (U.S. Pat. No. 5,520,369) describes such a device comprising two blocks, at least one compensation cylinder connected to accumulators, a cable and two articulated arms including sheaves and rods that allow to compensate for a motion for an element hanging from a mobile unit. This system allows to reduce the volume of the accumulators through a suitable geometry of the articulated arms. However, this system is not perfect: an error remains between the real force and the constant value because the cylinder pressure setpoint is not constant since the volume of the accumulators is limited and the ideal gas specific constant $\gamma$ of the air contained in the accumulators is different from one. Besides, the articulated arm system does not allow all of the above error to be rectified. The remaining error causes a variation in the hanging weight during drilling, which prevents the driller from rigorously applying the weight on bit setpoint.

The present invention relates to a motion compensation system for an element hanging from a mobile unit, the system comprising two blocks, at least two articulated arms, a compensation cylinder and a cable. According to the invention, at least one characteristic length of the articulated system (for example: the length of a link or the distance between two sheaves of two articulated arms) is controlled according to the motion so as to decrease the error and therefore to improve the motion compensation.

SUMMARY OF THE INVENTION

The invention relates to a motion compensation system for an element hanging from a mobile unit, said system comprising a first block and a second block for fastening said element, said first block being connected to said mobile unit by means of two articulated arms, each articulated arm comprising at least one sheave, said system comprising a cable fixed to retaining means and running through the sheaves of said articulated arms and through said first and second blocks, said system further comprising at least one compensation cylinder linked to said first block and to said mobile unit. The system comprises a means for adjusting at least one characteristic length of said articulated arms according to said motion.

According to the invention, each one of said articulated arms comprises at least one link, and said characteristic length of said articulated arms is the length of said link and/or the horizontal distance between the axes of said sheaves of said two articulated arms and/or the horizontal distance between the axis of said first block and the axis of said sheave of said articulated arm and/or the vertical distance between the lower position of the axis of said sheaves of said first block and the axis of said sheave of said articulated arm.

Advantageously, each one of said articulated arms comprises an idler sheave connected to said mobile unit, an intermediate sheave, a first link between said idler sheave and said intermediate sheave, and a second link between said intermediate sheave and said first block.

Advantageously, said adjusted characteristic length is determined by minimizing the error function defined by a formula of the form:

$$E = \frac{Fm - Fa}{Fm} \text{ with}$$

$$\frac{Fm}{Q} = 1 + \left[\sin(\theta + \varphi) + \frac{\sin(\beta) - \sin(\theta + \sigma - \varphi)}{\sin(\theta - \varphi)}\sin(\theta)\right]\frac{1}{N} + \frac{U}{Q}$$

and $$a = (Q + U)\frac{V_0^{\gamma}}{(V_0 + (De - De_0)S)^{\gamma}},$$

with:

φ: angle between the axis of the first link and the horizontal,

θ: angle between the axis of the second link and the horizontal,

β: angle between the cable and the axis of the first link,

σ: angle between the cable and the axis of the second link,

Fm: mechanical force on the compensation cylinder,

Q: weight of the hanging element,

U: constant related to the design of the system, corresponding to the sum of the weight of the first block, of the compensation cylinder rocks and of the articulated arms, Fa: pressure variation in the compensation cylinder, De: compensation cylinder stroke, with $De_0$ the initial stroke, $V_0$: reference volume of the compensation cylinder, N: number of sheaves, S: section of an accumulator equipping said compensation cylinder, Γ: gas constant, E: error function.

According to one aspect of the invention, said idler sheave is connected to said mobile unit by a controlled means of adjustable length.

According to one characteristic of the invention, at least one of said links comprises a hydraulic, pneumatic or electric cylinder controlled in position.

According to one embodiment of the invention, only a length of a link or only the distance between the axes of said sheaves is controlled.

Preferably, said first and second blocks are vertically aligned and said motion is vertical.

Advantageously, said mobile unit is an offshore unit, notably a ship.

Preferably, said element is a drill bit or a riser pipe or a parcel laying tool.

According to an aspect of the invention, said compensation cylinder is a pneumatic cylinder fed by at least one accumulator.

Furthermore, said cable retaining means can comprise at least one winch.

Moreover, the invention relates to the use of a compensation system according to the invention for drill bit support and/or for a riser pipe and/or for an offshore blowout preventer setting tool.

BRIEF DESCRIPTION OF THE FIGURES

Other features and advantages of the method according to the invention will be clear from reading the description hereafter of embodiments given by way of non limitative example, with reference to the accompanying figures wherein:

FIG. 1 (FIGS. 1*a* and 1*b*) illustrates a compensation system for two different positions, FIG. 2 illustrates an articulated arm of a compensation system.

DETAILED DESCRIPTION OF THE INVENTION

Figure 3:
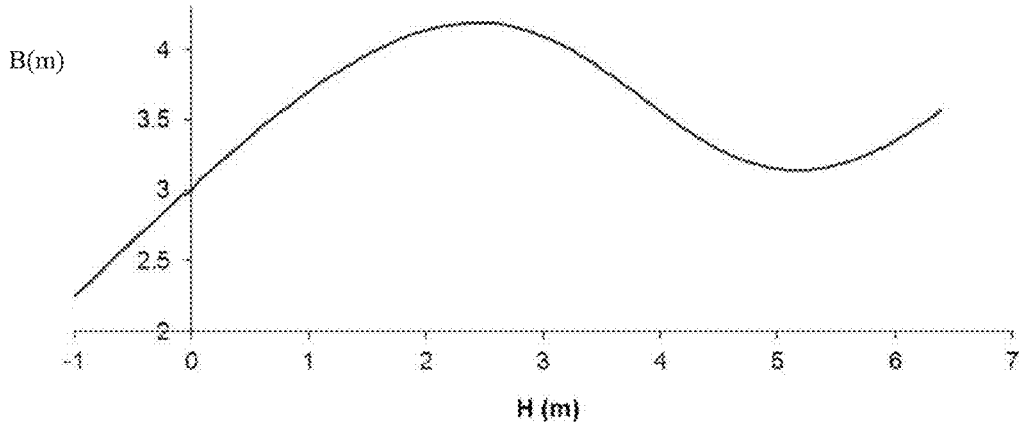
FIG. 3 is a curve illustrating the length variation of a first link of an articulated arm as a function of heave H.

The present invention relates to a motion compensation system for an element hanging from a mobile unit. The compensation system comprises:

a first block, equipped with at least one sheave, a second block, from which the element hangs, the second block being equipped with at least one sheave; preferably, the first and second blocks are vertically aligned, an articulated system comprising at least two articulated arms, preferably two or four, arranged symmetrically, the articulated system connecting the mobile unit to the first block, each articulated arm comprising at least one sheave, a cable fastened by retaining means to the mobile unit and running through the sheaves of the articulated arms and of the first and second blocks, the cable forming at least one loop around the first and second blocks, the cable retaining means on the mobile unit can comprise at least one winch allowing the cable length to be adjusted, and at least one cylinder, referred to as compensation cylinder, whose one end is connected to the first block and the other end is connected to the mobile unit; the cylinder is fed by at least one accumulator, for example through an oleopneumatic connection.

The motion of the mobile unit (heave for example) is largely compensated for by the movement of the first block with respect to the mobile unit. Thus, the second block is stationary with respect to a fixed reference point. The movement of the first block is controlled by the compensation cylinder and allowed by the articulated system.

According to the invention, at least one characteristic length of the articulated system is adjustable and adjusted (controlled) according to the motion so as to decrease the compensation error and to increase the compensation of the system. The characteristic length of the articulated system is continuously adjusted, in real time, while the compensation system is being used. The adjusted (controlled) characteristic length depends on the geometry (design) of the articulated system. It is a variable design length of the articulated system. This characteristic length is not a distance that varies due to the movement of the compensation cylinder. It can be the length of one of the parts of the articulated system, a link for example, or the distance from a sheave of the articulated system to the axis of the blocks, or the distance between two sheaves of the articulated system. The characteristic lengths of the articulated system are adjusted (controlled) simultaneously, in an identical manner, if the system is symmetric.

The characteristic length thus is variable, which is contrary to compensation systems of the prior art where the characteristic lengths (part lengths, sheave-block distances, sheave-sheave distances) are constant.

In the rest of the description, the compensation system is described in the case of an offshore use.

FIG. 1 shows a compensation system according to an embodiment of the invention in two positions (lower in FIG. 1*a* and upper in FIG. 1*b*) depending on the sea level. Compensation system 1 is installed on a mobile offshore unit. The compensation system allows to hang an element (not shown) on a second block 3 by means of a hook. Compensation system 1 also comprises a first block 2, two articulated arms 4 connected on the one hand to a support linked to the mobile unit 13 and, on the other hand, to first block 2, two compensation cylinders 5 connected to accumulators 11 by means of an oleopneumatic system 12 acting as an interface between hydraulic cylinders 5 and pneumatic accumulators 11, and a cable 10 running through the sheaves of articulated arms 4 and through first and second blocks 2 and 3. Cylinders 5 are connected to mobile unit 13 and to first block 2. As shown, first block 2, second block 3 and the hanging element are vertically aligned, and the motion to be compensated for is a vertical motion.

As illustrated, each articulated arm 4 comprises an idler sheave 6 connected to mobile unit 13, an intermediate sheave 7, a first link 8 between idler sheave 6 and intermediate sheave 7, and a second link 9 between intermediate sheave 7 and first block 2.

When sea level M is low (FIG. 1*a*), the rods of compensation cylinders 5 are completely extended and first block 2 is far from the level of mobile unit 13.

Conversely, when sea level M rises by a height Hm (FIG. 1*b*), the rods of compensation cylinders 5 are completely retracted and first block 2 is close to the level of mobile unit 13.

The articulated arms can be made up of links connecting sheaves. According to a first example, each articulated arm can comprise an idler sheave connected to the mobile unit, an intermediate sheave, a first link between the idler sheave and the intermediate sheave, and a second link between the intermediate sheave and the first block. According to a second example, each articulated arm can further comprise a second intermediate sheave and a third link between the two intermediate sheaves. These examples are not limitative, other variant embodiments may be considered.

The characteristic length of the articulated system, which is adjustable and adjusted according to the motion, can notably be the length of one of the links of the articulated system, the horizontal distance between the axis of the sheaves of the first block and of the idler sheave, etc. Preferably, only one characteristic length of each articulated arm is adjusted according to the motion. Alternatively, several characteristic lengths are adjusted simultaneously.

In order to adjust and to control the length of the links, they can be adjustable in length and comprise pneumatic, hydraulic or electric cylinders. In these three cases, the energy supply (pneumatic, hydraulic or electric) is controlled so as to actuate the cylinder in order to adjust the length of the link. According to other variant embodiments, links of adjustable size can be implemented by mechanical devices comprising a spring.

In order to adjust the position of the idler sheave, each idler sheave can be connected to the mobile unit by a controlled means of adjustable length, notably an electric, pneumatic or hydraulic cylinder for varying the horizontal and/or vertical distance from the axis of the sheave to the mobile unit. The cylinder can be positioned between the idler sheave and the mobile unit. For these three cases, the energy supply (pneumatic, hydraulic or electric) is controlled so as to actuate the cylinder in order to adjust the position of the idler sheave. Thus, the horizontal and/or vertical distance between the idler sheave and the axis of the first block or the horizontal and/or vertical distance between two idler sheaves is adjusted.

To control the adjustable characteristic length of the articulated arms, one can determine the variation in height of the motion to be compensated for by direct measurement of this height, for example by measuring the distance between the axis of the first block and the axis of the articulated arm sheave, by measuring the motion of the mobile unit or by measuring the various forces involved in the compensation system.

FIG. 2 schematically shows an articulated arm of a compensation system according to an embodiment of the invention. For this figure and for the rest of the description, the following notations are used:

A: horizontal distance between the axis of first block 2 and the axis of idler sheave 6, B: length of first link 8, referred to as lower link, C: length of second link 9, referred to as upper link, G: vertical distance between the lower position of the axis of the sheaves of first block 2 and the axis of idler sheave 6, H: vertical distance between the axis of first block 2 and the axis of idler sheave 6; H varies with the motion (heave) of the mobile unit, P: vertical distance between the upper position of the sheave of first block 2 and the lower position of the sheave of first block 2, we have P=G+H, Rc: radius of the sheave of first block 2, RI: radius of idler sheave 6, Rj: radius of intermediate sheave 7, $\varphi$: angle between the axis of first link 8 and the horizontal, $\theta$: angle between the axis of second link 9 and the horizontal, $\beta$: angle between cable 10 and the axis of first link 8, $\sigma$: angle between cable 10 and the axis of second link 9, Fm: mechanical force on compensation cylinders 5, Q: weight of the hanging element, U: constant related to the system design, corresponding to the sum of the weights of the first block, the cylinder rods and the articulated arms, Fa: pressure variation in compensation cylinders 5, Gf: geometrical factor, De: stroke of compensation cylinders 5, with $De_0$ the initial stroke, $V_0$: reference volume of the compensation cylinder, N: number of sheaves, S: section of main accumulators 11, $\gamma$: gas constant, E: error.

As shown in FIG. 2, the articulated system comprises an idler sheave 6 of radius RI, an intermediate sheave 7 of radius Rj, a first link 8 of length B between idler sheave 6 and intermediate sheave 7, and a second link of length C between intermediate sheave 7 and the sheave of first block 2. According to the invention, at least one of the links can be of adjustable and controlled length. First block 2 is shown in dotted line in lower position in the figure. The compensation system comprises two compensation cylinders 5.

The path of the cable between first block 2 and idler sheave 6 can have four variants:

no crossing of cable 10 with one of first and second links 8 and 9, the cable then runs on the outside of the sheaves, crossing of cable 10 and first link 8 as illustrated in FIG. 2, crossing of cable 10 and second link 9, and crossing of first and second links 8 and 9.

In all these configurations, the equation relating the mechanical force on the cylinders to the forces due to the hanging weights is of the form:

$$\frac{Fm}{Q} = 1 + \left[\sin(\theta+\varphi) + \frac{\sin(\beta) - \sin(\theta+\sigma-\varphi)}{\sin(\theta-\varphi)}\sin(\theta)\right]\frac{1}{N} + \frac{U}{Q}$$

The equation of pressure variation in the compensation cylinders supporting first block 2 can be written:

$$Fa = (Q+U)\frac{V_0^{\gamma}}{(V_0 + (De - De_0)S)^{\gamma}}$$

The error is written by a relation of the form:

$$E = \frac{Fm - Fa}{Fm}$$

Force Fm depending on a geometrical factor Gf that is a function of the length of the two links, of the sheave radii and of the vertical movement of first block 2, this geometrical factor can be written as follows:

$$Gf = \sin(\theta + \varphi) + \frac{\sin(\beta) - \sin(\theta + \sigma - \varphi)}{\sin(\theta - \varphi)}\sin(\theta)$$

Thus, the equation of the mechanical force on the cylinders can be simplified by a relation of the form:

$$\frac{Fm}{Q} = 1 + \frac{Gf}{N} + \frac{U}{Q}$$

In the particular case where intermediate sheave 7 has the same diameter as the sheave of first block 2, i.e. Rj=Rc, we can write: [illegible] and thus simplify geometrical factor Gf according to the following formula:

$$Gf = \frac{\sin(\beta)\sin(\theta)}{\sin(\theta - \varphi)}$$

Angles β and α only depend on lengths B and C and on the sheave radii. Angles θ and φ depend on H, which varies with the motion of the mobile unit (heave). However, these angles also depend on lengths A, B, C and G resulting from the compensator design.

The invention consists in varying one of these parameters: lengths A, B, C and G as a function of H so as to cancel the error defined by means of the above equations. Geometrical factor Gf (see above) only depends on angles that are themselves functions of geometrical quantities A, B, C and G. Gf also depends on H. H is a function of time since it represents the motion of the mobile unit (drill ship heave for example). U is a constant related to the system design. Q is the hanging weight (hanging from the second block) minus the WOB (weight setpoint on the hanging element). Since the purpose of the compensation system consists in keeping parameter WOB constant, Q is considered to be constant. Therefore, force Fm only depends on lengths A, B, C, G and H.

Furthermore, force Fa depends on constants (Q, U, Vo and $De_0$). De, which is the cylinder stroke, varies as a function of H through a function of the form $$De = \frac{H}{\cos(\psi)} + \text{constant},$$

ψ being the angle of compensation cylinders 5 to the vertical.

Error function E therefore only depends on lengths A, B, C, G and H. If we vary one of the quantities A, B, C or G as a function of time, this function can be made independent of H.

The function relating length A, B, C or G to H for cancelling error E is unequivocal: for a given H, there is only one A, B, C or G allowing the error to be cancelled.

However, once the dimensions known, a polynomial function or a sequence of sinusoidal functions relating A, B, C or G to H can be found. Once this function or this sequence of functions known, it is then possible to directly control lengths A, B, C or G once H measured. For example, lengths A and B can be adjusted by means of links of adjustable length that can comprise at least one cylinder. For example, lengths C and G can be adjusted by adjusting the respectively horizontal and vertical position of the idler sheave, notably by means of an adjusting cylinder (arranged respectively horizontally and vertically) positioned between the mobile unit and the idler sheave.

H being the distance between the axis of the first block and the axis of the idler sheave, direct measurement of this distance can be performed. However, this distance, which can represent the mobile unit heave motion, is also a function of lengths B or C.

Another solution can consist in measuring the mobile unit heave motion. Length H is deduced from this measurement by subtracting from the measurement length G which is a design constant of the compensation system. A, B, C or G can be directly controlled from the knowledge of H. This solution allows to do without a control feedback loop.

In order to improve the control quality, it is also possible to use the measurements of Fm and Fa already existing on a drill ship to determine length H.

The compensation system according to the invention can be used notably for compensating the heave motion of a ship during offshore drilling operations, when setting a riser pipe, for a blowout preventer setting tool or downhole workover for resumption of drilling. In this case, the mobile unit is a floating unit, notably a ship, and the hanging element is a drill bit or a riser pipe or an offshore pipe laying tool.

Thus, the compensation system according to the invention allows to cancel the compensation error inherent in systems of the prior art. The invention also allows heave compensation even when the element (a drill bit for example) does not rest on the sea bottom (the well bottom for example). Indeed, the compensation systems of the prior art are all designed to maintain the hook load constant during use (for example during drilling). During non-use phases (non-drilling stage for example), the heave compensators of the prior art are ineffective because the hook load does not vary during a heave period. The vertical accelerations induced by the heave motion are then too weak to be detected by these systems. On the other hand, controlling, according to the invention, a characteristic length of the articulated arms depending on the heave allows to keep the hook at a fixed vertical distance from the sea bottom.

Furthermore, the design of the articulated arm with links of adjustable length or with means for varying the articulated system distances allows to reduce the volume of the compensation cylinder accumulators.

In order to demonstrate the feasibility of this invention, we examine the effect of the length variation of one of the two links B or C according to heave H to cancel error E.

We therefore present an application example of a drill ship configuration undergoing heave motion, the articulated arms being made according to the embodiment of FIG. 2:

Sheave radius: 0.73 m

Number of sheaves of the first block: 7

Distance A: 2 m

Distance G: 1 m

Air volume $V_0$: 10 m3

Total section of compensation cylinders S: 2083.34 cm2
Gas factor γ: 1.4
Hanging element weight Q: 454†
Heave: 7 m
Minimum value of H: −1 m (H ranges from −1 m to 6 m).

For an example of the prior art where the links are rods of fixed length, if we seek the best pair that minimizes the error, we find:

First link length B: 3.55 m
Second link length C: 3.55 m
Maximum error E: 3.15%
Cable length variation: 1.8 m.

For a first example according to the invention where the length of the first link is adjustable, we calculate the variations of length B to cancel error E whatever heave H. For this example, we keep the value of length C calculated above for the example of the prior art, i.e. C=3.55 m.

FIG. 3 illustrates the variations of length B that cancel error E for each heave height H. It can be noted that length B ranges from 2.25 m to 4.20 m, i.e. a 1.95 m stroke. The variation of length B of the first link also causes a cable length variation of 0.93 m.

For a second example according to the invention where the length of the second link is adjustable, we calculate the variations of length C to cancel error E whatever heave H. For this example, we keep the value of length B calculated above for the example of the prior art, i.e. B=3.55 m.

Figure 4:
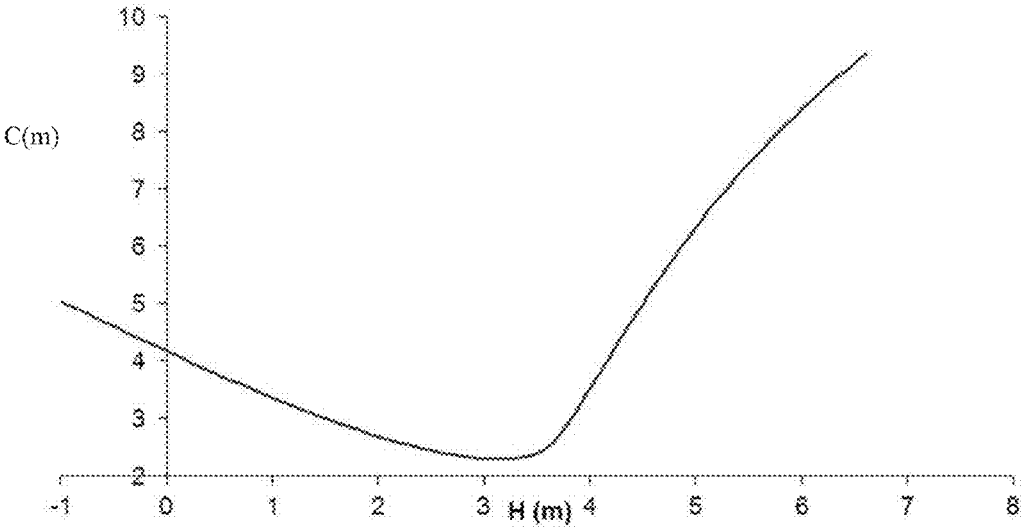
FIG. 4 is a curve illustrating the length variation of a second link of an articulated arm as a function of heave H.

FIG. 4 illustrates the variations of length C that cancel error E for each heave height H. It can be noted that length C ranges from 2.30 m to 9.37 m, i.e. a 7.07 m stroke. The variation of length C of the second link also causes a cable length variation of 9.67 m.

It is thus possible to cancel the error of the heave compensation system of the prior art by adjusting either the horizontal and/or vertical position of the idler sheave, or the length of one of the links as a function of heave H of the drill ship.

The invention claimed is:

1. A motion compensation system for an element hanging from a mobile unit, said system comprising a first block and a second block for hanging said element, said first block being connected to said mobile unit by at least two articulated arms, each articulated arm comprising an idler sheave connected to said mobile unit, an intermediate sheave, a first link between said idler sheave and said intermediate sheave, and a second link between said intermediate sheave and said first block, said system comprising a cable fastened to retaining means and running through the idler sheave and the intermediate sheave of each of said articulated arms and through said first and second blocks, said system further comprising at least one compensation cylinder linked to said first block and to said mobile unit, and a means for adjusting at least one characteristic length of said articulated arms according to motion of said mobile unit, the at least one characteristic length is at least one of a horizontal distance between the axis of first block and the axis of idler sheave, a length of the first link or the second link, a vertical distance between a lower position of an axis of a sheave of the first block and the axis of the idler sheave.

2. The system as claimed in claim 1, wherein said adjusted characteristic length is length that minimizes an error function defined by a formula of the form:

$$E = \frac{Fm - Fa}{Fm} \text{ with}$$

-continued $$\frac{Fm}{Q} = 1 + \left[\sin(\theta + \varphi) + \frac{\sin(\beta) - \sin(\theta + \sigma - \varphi)}{\sin(\theta - \varphi)}\sin(\theta)\right]\frac{1}{N} + \frac{U}{Q}$$

and $$a = (Q + U)\frac{V_0^{\gamma}}{(V_0 + (De - De_0)S)^{\gamma}},$$

with:

φ: angle between the axis of the first link and the horizontal,
θ: angle between the axis of the second link and the horizontal,
β: angle between the cable and the axis of the first link,
σ: angle between the cable and the axis of the second link,
Fm: mechanical force on the compensation cylinder,
Q: weight of the hanging element,
U: constant related to the design of the system, corresponding to the sum of the weight of the first block, of the compensation cylinder rocks and of the articulated arms,
Fa: pressure variation in the compensation cylinder,
De: compensation cylinder stroke, with $De_0$ the initial stroke,
$V_0$: reference volume of the compensation cylinder,
N: number of sheaves,
S: section of an accumulator equipping said compensation cylinder,
Γ: gas constant,
E: error function.

3. The system as claimed in claim 1, wherein said idler sheave is connected to said mobile unit by a controlled means of adjustable length.

4. The system as claimed in claim 1, wherein at least one of said links comprises a hydraulic, pneumatic or electric cylinder controlled in position.

5. The system as claimed in claim 1, wherein only a length of a link or only distance between the axes of said sheaves is controlled.

6. The system as claimed in claim 1, wherein said first and second blocks are vertically aligned and said motion is vertical.

7. The system as claimed in claim 1, wherein said mobile unit is an offshore unit, notably a ship.

8. The system as claimed in claim 7, wherein said element is a drill bit or a riser pipe or a parcel laying tool.

9. The system as claimed in claim 1, wherein said compensation cylinder is a pneumatic cylinder fed by at least one accumulator.

10. The system as claimed in claim 1, wherein said means for retaining cable comprise at least one winch.

11. A drill bit support comprising the motion compensation system as claimed in claim 1.

12. A riser pipe comprising the motion compensation system as claimed in claim 1.

13. An offshore blowout preventer comprising the motion compensation system as claimed in claim 1.

14. A motion compensation system for an element hanging from a mobile unit, the system comprising a first block and a second block for hanging the element, the first block being connected to the mobile unit by at least two articulated arms, each articulated arm comprising an idler sheave connected to said mobile unit, an intermediate sheave, a first link between said idler sheave and said intermediate sheave, and a second link between said intermediate sheave and said first block, the system comprising a cable fastened to retaining means and running through the idler sheave and intermediate sheave of each of the articulated arms and through the first and second blocks; at least one compensation cylinder linked to the first block and to said mobile unit; and an adjustable cylinder of adjustable length for adjusting at least one characteristic length of the articulated arms according to motion of the mobile unit, the at least one characteristic length is at least one of a horizontal distance between the axis of first block and the axis of idler sheave, a length of the first link or the second link, a vertical distance between a lower position of an axis of a sheave of the first block and the axis of the idler sheave.

15. The system as claimed in claim 14, wherein the adjustable cylinder comprises a pneumatic cylinder, a hydraulic cylinder or an electric cylinder connected between the mobile unit and the at least one sheave of at least one of the articulated arms.

16. A drill bit support comprising the motion compensation system as claimed in claim 14.

17. A riser pipe comprising the motion compensation system as claimed in claim 14.

18. An offshore blowout preventer comprising the motion compensation system as claimed in claim 14.

* * * * *